US011933526B2

(12) United States Patent
Gao

(10) Patent No.: US 11,933,526 B2
(45) Date of Patent: Mar. 19, 2024

(54) COMPRESSOR AND REFRIGERATION DEVICE

(71) Applicant: GUANGDONG MEIZHI COMPRESSOR CO., LTD., Guangdong (CN)

(72) Inventor: Bin Gao, Guangdong (CN)

(73) Assignee: GUANGDONG MEIZHI COMPRESSOR CO., LTD., Guangdong (CN)

( * ) Notice: Subject to any disclaimer, the term of this patent is extended or adjusted under 35 U.S.C. 154(b) by 474 days.

(21) Appl. No.: 17/153,367

(22) Filed: Jan. 20, 2021

(65) Prior Publication Data

US 2021/0164712 A1 Jun. 3, 2021

Related U.S. Application Data

(63) Continuation of application No. PCT/CN2018/117592, filed on Nov. 27, 2018.

(30) Foreign Application Priority Data

Jul. 25, 2018 (CN) ..... 201810827208.9
Jul. 25, 2018 (CN) ..... 201810828639.7
(Continued)

(51) Int. Cl.
*F25B 41/26* (2021.01)
*F25B 13/00* (2006.01)
*F25B 49/02* (2006.01)

(52) U.S. Cl.
CPC ..... *F25B 41/26* (2021.01); *F25B 13/00* (2013.01); *F25B 49/02* (2013.01);
(Continued)

(58) Field of Classification Search
CPC ..... F25B 41/26; F25B 13/00; F25B 49/02; F25B 2400/0401; F25B 2400/0403;
(Continued)

(56) References Cited

U.S. PATENT DOCUMENTS 3,310,956 A * 3/1967 Honda ..... F25B 47/022 62/278
2008/0317610 A1 12/2008 Masao

FOREIGN PATENT DOCUMENTS

CN 101084401 A 12/2007
CN 106104174 A 11/2016
(Continued)

OTHER PUBLICATIONS

JP-H1038390-A English Translation (Year: 1998).*
(Continued)

*Primary Examiner* — David J Teitelbaum
*Assistant Examiner* — Devon Moore
(74) *Attorney, Agent, or Firm* — Scully, Scott, Murphy & Presser, P.C.

(57) ABSTRACT

A compressor and a refrigeration device are disclosed. The compressor has a sealing container, a motor portion and a compressing mechanism portion, and a bypass valve. The motor portion and the compressing mechanism portion are both provided in the sealing container. The compressor has an exhaust side and a suction side spaced apart from each other. The exhaust side is connected to the bypass valve. The exhaust side is suitable for exhausting air to external parts through the bypass valve, or suitable for communicating with the suction side through the bypass valve.

14 Claims, 9 Drawing Sheets

(30) Foreign Application Priority Data

Jul. 25, 2018 (CN) ..... 201821192650.0
Jul. 25, 2018 (CN) ..... 201821192720.2

(52) U.S. Cl.
CPC ... *F25B 2400/0401* (2013.01); *F25B 2500/26* (2013.01); *F25B 2600/2501* (2013.01)

(58) Field of Classification Search
CPC ..... F25B 2400/0409; F25B 2500/26; F25B 2600/2501; F25B 2600/2507; F25B 41/22; F25B 2313/02742; F25B 2313/02741
See application file for complete search history.

(56) References Cited

FOREIGN PATENT DOCUMENTS

| | | | | | |
|---|---|---|---|---|---|
| JP | H1038390 | A | * | 2/1998 | ..... F25B 2600/026 |
| JP | 2018-091540 | A | | 6/2018 | |
| KR | 20100026266 | A | * | 3/2010 | ..... F16K 11/02 |
| KR | 20160144097 | A | * | 12/2016 | ..... F25B 13/00 |
| WO | WO-9717643 | A1 | * | 5/1997 | ..... F25B 41/062 |
| WO | WO-2012143778 | A1 | * | 10/2012 | ..... B60H 1/00278 |
| WO | WO-2015131313 | A1 | * | 9/2015 | ..... F04B 25/005 |
| WO | WO-2016192146 | A1 | * | 12/2016 | ..... F16K 11/07 |
| WO | WO-2017031669 | A1 | * | 3/2017 | ..... F04C 18/34 |
| WO | WO-2018163422 | A1 | * | 9/2018 | ..... F25B 13/00 |

OTHER PUBLICATIONS

WO-2017031669-A1 English Translation (Year: 2017).*
KR-20100026266-A English Translation (Year: 2010).*
WO-2016192146-A1 English Translation (Year: 2016).*
WO-2018163422-A1 English translation (Year: 2018).*
KR-20160144097-A English translation (Year: 2016).*
WO-2015131313-A1 English translation (Year: 2015).*
Office Action dated Jun. 7, 2022 received in Canadian Patent Application No. CA 3,107,528.
International Search Report and Written Opinion dated Jan. 31, 2019 received in International Application No. PCT/CN2018/117592 together with an English language translation.
Office Action dated Dec. 16, 2022 received in Canadian Patent Application No. CA 3,107,528.

* cited by examiner

COMPRESSOR AND REFRIGERATION DEVICE

CROSS-REFERENCE TO RELATED APPLICATION

The present application is a continuation application of PCT International Application No. PCT/CN2018/117592, filed on Nov. 27, 2018, which claims priority to Chinese Patent Application Serial Nos. 201810827208.9, 201821192650.0, 201810828639.7 and 201821192720.2, entitled "Compressor and Refrigeration Device", filed by Guangdong Meizhi Refrigeration Equipment Company Limited on Jul. 25, 2018, the entire contents of which are incorporated herein by reference for all purposes. No new matter has been introduced.

FIELD

The present disclosure pertains to the field of compressor manufacturing technologies, and particularly relates to a compressor and a refrigeration device comprising the same.

BACKGROUND

In a refrigeration device, a refrigerant is converted between low temperature and low pressure and high temperature and high pressure under the compression action of a compressor and the throttling function of a throttling structure, and heat exchange with the surrounding environment is realized with heat exchangers, so as to achieve a refrigeration or heating effect. The compressor is one of the important parts in the refrigeration device, and the design of the compressor has an important influence on the energy efficiency and the operational reliability of the refrigeration device.

After stopped after last operation, the compressor may be restarted only when the pressure difference between the suction side and the exhaust side of the compressor reaches a certain required range. This is especially the case for a rolling rotor compressor, in which the pressure difference must reach a smaller value, for example, within 1 kgf/cm$^2$; otherwise, the compressor is unable to be restarted, and therefore, a quick starting function is unable to be achieved. On the other hand, in the related art, after the compressor is stopped, the refrigerant in a high-pressure-side heat exchanger rapidly returns to the low-pressure side through clearances between the parts of the compressor, so as to raise the temperature and pressure in a low-pressure-side heat exchanger, and in this case, heat in the high-pressure-side heat exchanger may be wasted, the refrigeration capacity in the low-pressure-side heat exchanger may be lost, which is not favorable for the operation efficiency of the refrigeration device.

In the refrigeration device, the refrigerant is converted between low temperature and low pressure and high temperature and high pressure under the compression action of the compressor and the throttling function of the throttling structure, and heat exchange with the surrounding environment is realized with the heat exchangers, so as to achieve the refrigeration or heating effect. The compressor is one of the important parts in the refrigeration device, and the design of the compressor has an important influence on the energy efficiency and the operational reliability of the refrigeration device.

SUMMARY

The present disclosure seeks to solve at least one of the problems existing in the prior art. A compressor according to embodiments of the present disclosure includes: a sealing container; a motor portion and a compressing mechanism portion provided in the sealing container; and a bypass valve; wherein the compressor has an exhaust side and a suction side spaced apart from each other, the exhaust side is connected to the bypass valve, and the exhaust side is suitable for exhausting air to external parts through the bypass valve or suitable to be communicated with the suction side through the bypass valve.

The compressor according to the embodiments of the present disclosure may be restarted rapidly, and residual heat may be utilized after the compressor is stopped, with a high energy efficiency.

In the compressor according to one embodiment of the present disclosure, the bypass valve includes: a valve body defining a valve cavity, the valve body being provided with a plurality of ports in communication with the valve cavity, and the ports being configured to be connected to the exhaust side, the suction side and the external parts; and a valve core movably provided in the valve body and provided with a flow passage, the ports being selectively communicated through the flow passage.

In the compressor according to one embodiment of the present disclosure, the bypass valve further includes an electromagnetic control portion electromagnetically connected to the valve core.

In the compressor according to one embodiment of the present disclosure, the bypass valve includes a first port, a second port and a third port, the first port is selectively communicated with one of the second and third ports, and is communicated with the exhaust side, the third port is communicated with the suction side, and the exhaust side is suitable for exhausting air to the external parts through the second port.

In the compressor according to one embodiment of the present disclosure, at least part of the valve core is movably provided in the valve body in the axial direction of the valve body, the first port is provided at a first end portion of the axial direction of the valve body, the second port is provided at a first side surface of the valve body, the third port is provided at a second side surface of the valve body, and the flow passage has a first open end facing the first end portion, a second open end facing the first side surface, and a third open end facing the second side surface; the first port is communicated with the second port when the second open end is opposite to the second port; the first port is communicated with the third port when the third open end is opposite to the third port.

In the compressor according to one embodiment of the present disclosure, the bypass valve includes a first port, a second port, a third port and a fourth port, the first port is selectively communicated with one of the second and third ports, the fourth port is selectively communicated with the third port, the first port is communicated with the exhaust side, the third port is communicated with the suction side, and when the first port is communicated with the second port and the third port is communicated with the fourth port, the exhaust side is suitable for exhausting air to the external parts through the second port, and the suction side is suitable for sucking air to the external parts through the fourth port.

In the compressor according to one embodiment of the present disclosure, the valve core has a first flow passage, a second flow passage and a third flow passage, the first and second ports are suitable for being communicated through the first flow passage, and the third and fourth ports are suitable for being communicated through the second flow passage, or the first and third ports are suitable for being communicated through the third flow passage.

In the compressor according to one embodiment of the present disclosure, at least part of the valve core is movably provided in the valve body in the axial direction of the valve body, the first and third ports are provided at the first side surface of the valve body and spaced apart in the axial direction, the second and fourth ports are provided at the second side surface of the valve body and spaced apart in the axial direction, two open ends of the first flow passage and two open ends of the second flow passage face the first and second side surfaces of the valve body respectively, and two open ends of the third flow passage face the first side surface of the valve body.

In the compressor according to one embodiment of the present disclosure, the first and second flow passages are spaced apart in the axial direction of the valve core, and the width of the second flow passage in the axial direction of the valve core is greater than the width of the first flow passage in the axial direction of the valve core.

In the compressor according to one embodiment of the present disclosure, the bypass valve has a first state in which the exhaust side is communicated with the external parts through the bypass valve and a second state in which the exhaust side is communicated with the suction side through the bypass valve; the compressor is configured, such that the bypass valve is switched from the first state to the second state when the motor portion is stopped from an operating state, and from the second state to the first state when the motor portion is started from the stopped state.

In the compressor according to one embodiment of the present disclosure, the bypass valve has a first state in which the exhaust side is communicated with the external parts through the bypass valve and disconnected from the suction side, a second state in which the exhaust side is disconnected from the external parts and communicated with the suction side through the bypass valve, and a third state in which the exhaust side is disconnected from the external parts and the suction side.

The compressor according to one embodiment of the present disclosure is configured, such that the bypass valve is switched from the first state to the second state when the motor portion is stopped from an operating state, and from the second state to the third state when the motor portion is started from the stopped state; when P1 is greater than or equal to P2, the bypass valve is switched to the first state, and when P1 is less than P2, the bypass valve remains in the third state when the motor portion is not stopped, and is switched to the second state when the motor portion is stopped; P1 is the pressure at the first port, and P2 is the pressure at the second port.

The compressor according to one embodiment of the present disclosure is configured, such that the bypass valve is switched from the first state to the second state when the motor portion is stopped from the operating state, and from the second state to the third state when the motor portion is started from the stopped state, and after remaining in the third state for a preset time t, the bypass valve is switched to the first state when the motor portion is not stopped, and to the second state when the motor portion is stopped.

The compressor according to one embodiment of the present disclosure satisfies the condition that t is greater than or equal to 1 second and less than or equal to 10 seconds.

The compressor according to one embodiment of the present disclosure further includes a reservoir having an outlet communicated with an air inlet of the compressing mechanism portion, an air suction pipe being provided at the reservoir, and the suction side including the reservoir and the air suction pipe; the sealing container defining a high-pressure containing cavity, an exhaust pipe being provided at the sealing container, and the exhaust side including the containing cavity and the exhaust pipe.

In the compressor according to one embodiment of the present disclosure, the sealing container defines a low-pressure first cavity and a high-pressure second cavity, and is provided with an air suction pipe in communication with the first cavity and an exhaust pipe in communication with the second cavity, the suction side includes the first cavity and the air suction pipe, and the exhaust side includes the second cavity and the exhaust pipe.

The present disclosure further provides a refrigeration device, including: a first heat exchanger, a throttle valve, a second heat exchanger and the compressor according to any one of the above-mentioned embodiments, wherein a first connector of the first heat exchanger is connected to the bypass valve, the throttle valve is connected between a second connector of the first heat exchanger and a first connector of the second heat exchanger, and a second connector of the second heat exchanger is connected to an air suction port of the compressor.

The present disclosure further provides a refrigeration device, including: a reversing device, a first heat exchanger, a throttle valve, a second heat exchanger and the compressor according to any one of the above-mentioned embodiments, wherein the reversing device includes a first opening, a second opening, a third opening and a fourth opening, the first opening is connected to the bypass valve, the second opening is connected to a first connector of the first heat exchanger, the throttle valve is connected between a second connector of the first heat exchanger and a first connector of the second heat exchanger, a second connector of the second heat exchanger is connected to the fourth opening, and the third opening is connected to an air suction port of the compressor.

The advantages of the refrigeration device are the same as the advantages of the above-mentioned compressor compared with the prior art, and are not repeated herein.

Additional aspects and advantages of the present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the present disclosure will become apparent and more readily appreciated from the following descriptions made with reference to the drawings, in which.

REFERENCE NUMERALS

Figure 1:
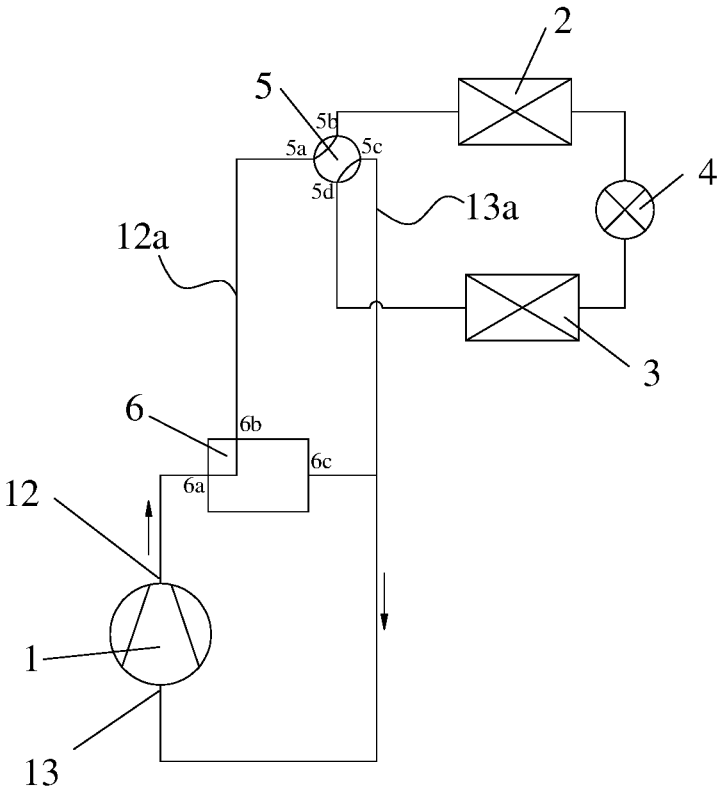
FIGS. 1 to 5 are schematic structural diagrams of a refrigeration device according to a first embodiment of the present disclosure.

Compressor 1, sealing container 11, exhaust pipe 12, exhaust-side pipeline 12*a*, air suction pipe 13, suction-side pipeline 13*a*, a motor portion and a compressing mechanism portion 15, first heat exchanger 2, second heat exchanger 3, throttle valve 4, reversing device 5, first opening 5*a*, second opening 5*b*, third opening 5*c*, fourth opening 5*d*, bypass valve 6, first port 6*a*, second port 6*b*, third port 6*c*, valve body 6*d*, valve core 6*e*, flow passage 6*f*, electromagnetic control portion 6*g*, fourth port 6*h*, first flow passage 6*i*, second flow passage 6*j*, and third flow passage 6*k*.

DETAILED DESCRIPTION OF EMBODIMENTS

A compressor 1 according to embodiments of the present disclosure will be described below with reference to FIGS. 1 to 8.

As shown in FIGS. 1 to 8, a compressor 1 according to one embodiment of the present disclosure includes: a sealing container 11, a motor portion and a compressing mechanism portion 15, and a bypass valve 6.

The compressor 1 has an exhaust side and a suction side which are spaced apart, the exhaust side is configured as a high-pressure side, and the suction side is configured as a low-pressure side. The motor portion and the compressing mechanism portion 15 are both provided in the sealing container 11, and the motor portion is configured to drive the compressing mechanism portion to realize air suction and compressed air exhaust. The bypass valve 6 includes a first port 6*a*, a second port 6*b* and a third port 6*c*. The first port 6*a* may be selectively communicated with one of the second and third ports 6*b*, 6*c*, the first port 6*a* is communicated with the exhaust side of the compressor 1, the third port 6*c* is communicated with the suction side of the compressor 1, and the exhaust side is suitable for exhausting air to external parts through the second port 6*b*. In other words, the compressor 1 is connected to an external pipeline through the second port 6*b*, and when the first port 6*a* is disconnected from the second port 6*b*, the exhaust side of the compressor is disconnected from the external pipeline, and residual heat of a high-pressure-side heat exchanger may be used continuously.

When the compressor 1 is started to work normally, the motor portion works, the first and second ports 6*a*, 6*b* of the bypass valve 6 are communicated with each other, the third port 6*c* of the bypass valve 6 is disconnected from the first port 6*a*, the third port 6*c* is disconnected from the first port 6*a*, and high-pressure gas output from the compressor 1 is output from the exhaust side to an exhaust-side pipeline 12*a* of a refrigeration device through the first and second ports 6*a*, 6*b*, and the suction side of the compressor 1 sucks air through a suction-side pipeline 13*a*.

When the compressor 1 stops operating, the motor portion does not work, the first and third ports 6*a*, 6*c* of the bypass valve 6 are communicated with each other, and the first port 6*a* is disconnected from the second port 6*b*. That is, the bypass valve 6 communicates the exhaust and suction sides of the compressor 1, and disconnects the exhaust side of the compressor 1 from other components of the refrigeration device.

Thus, when the compressor 1 is stopped, the pressures on the exhaust and suction sides of the compressor 1 may be balanced promptly, facilitating quick restart of the compressor 1.

On the other hand, when the compressor 1 is stopped, the bypass valve 6 cuts off the communication between the exhaust side of the compressor 1 and the refrigeration device, the interior of the high-pressure-side heat exchanger is kept in a high pressure state, and a throttle valve 4 (which will be described later) still has a certain flow rate under the action of a pressure difference, such that the residual heat of the high-pressure-side heat exchanger may be still released, and a low-pressure-side heat exchanger still has the capacity of heat absorption by evaporation. Thus, when the compressor 1 is stopped, the refrigeration device is still able to utilize the residual heat in the heat exchanger, thereby improving the overall efficiency of the refrigeration device and realizing utilization of the residual heat of a system, with the advantages of simplicity, reliability, high efficiency and energy conservation.

In the present disclosure, after the compressor 1 is stopped, the bypass valve 6 disconnects the high-pressure side of the compressor from the high-pressure side heat exchanger and directly communicates the high-pressure side to the low-pressure side of the compressor, the high-pressure side of the compressor has a small volume, and the bypass valve 6 has a direct communication channel, such that the high-pressure and low-pressure sides of the compressor 1 may realize a pressure balance rapidly to meet the requirement that the pressure difference when the compressor is started is less than 1 $kgf/cm^2$, thereby achieving the function of quick restart after the compressor is stopped. According to the size of a bypass channel of the selected bypass valve 6, pressure balance time obtained by the inventor of the present disclosure through a large number of experimental tests may meet the requirement of the rapidest pressure balance within 1 minute.

From the above description, in the compressor 1 according to the embodiments of the present disclosure, the dual effects of residual heat utilization and the rapid pressure balance of the system may be achieved at the same time only by adding one bypass valve 6, and this solution is particularly suitable for occasions where the compressor is sensitive to the starting pressure difference and has large starting torque and a rapid restart requirement, is particularly effective for the application of a rotor compressor, and has the advantages of a low cost, a wide application range, and simple and reliable control.

The compressor 1 according to the embodiment of the present disclosure may be restarted rapidly, and the residual heat may be utilized after the compressor 1 is stopped, with a high energy efficiency.

The structure of the bypass valve 6 according to certain exemplary embodiments of the present disclosure will be described below with reference to FIGS. 6 to 8.

Figure 6:
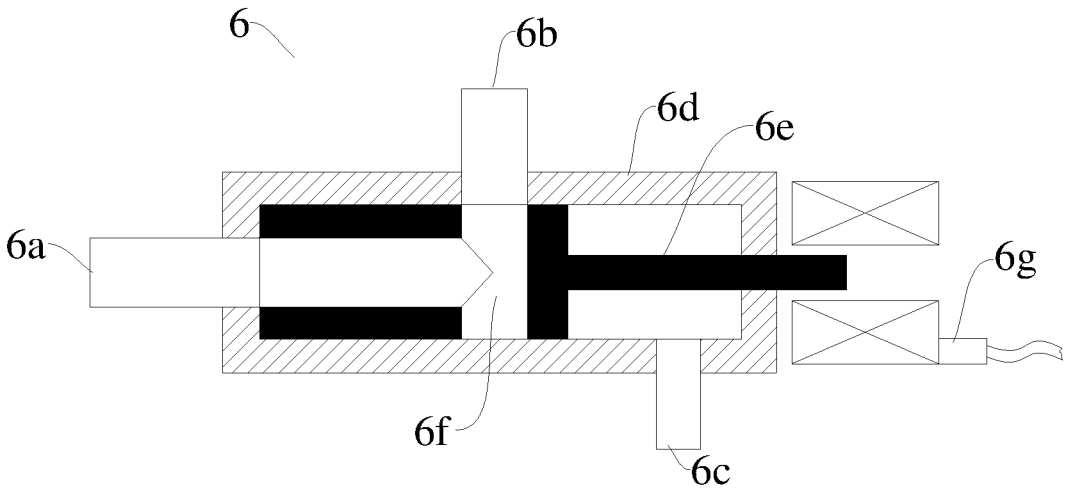
FIG. 6 is a schematic structural diagram of a bypass valve according to a first embodiment of the present disclosure in a first state.
Figure 7:
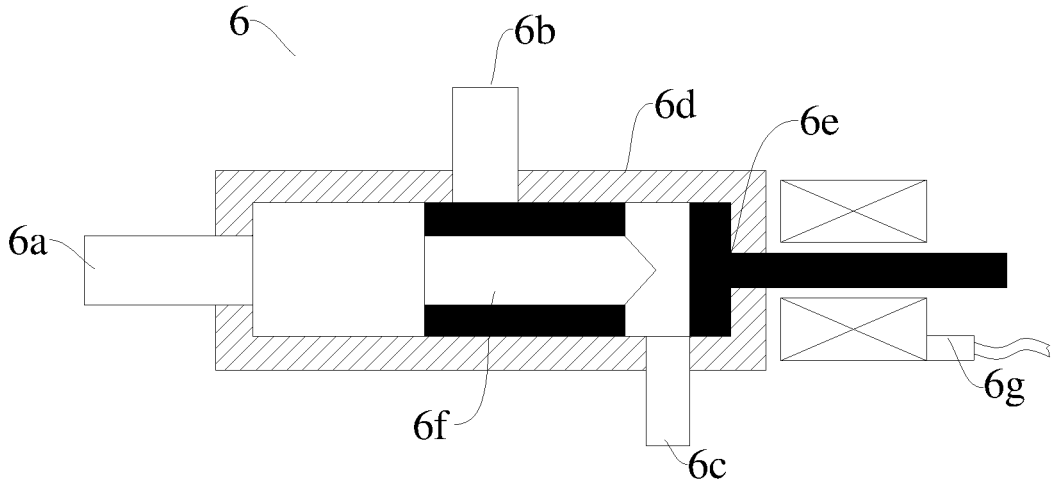
FIG. 7 is a schematic structural diagram of the bypass valve according to the first embodiment of the present disclosure in a second state.
Figure 8:
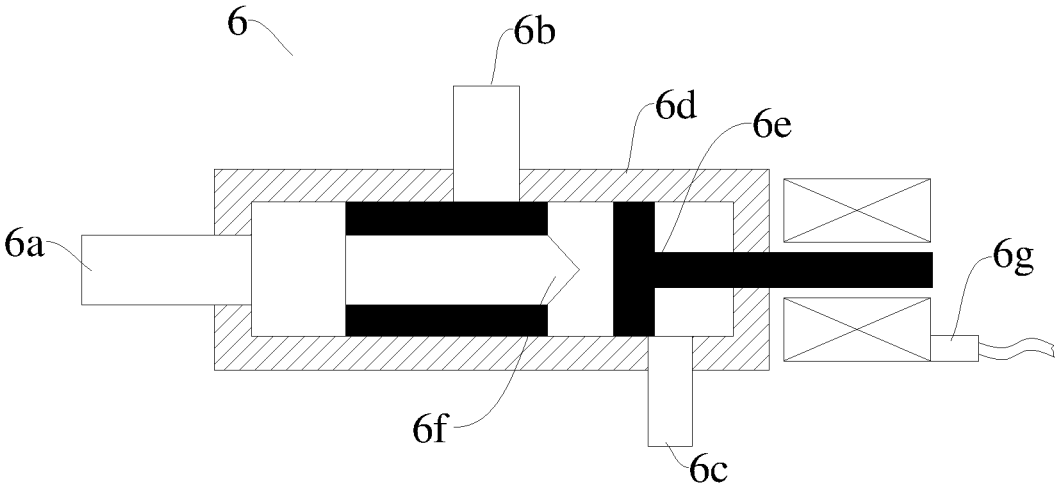
FIG. 8 is a schematic structural diagram of the bypass valve according to the first embodiment of the present disclosure in a third state.
Figure 9:
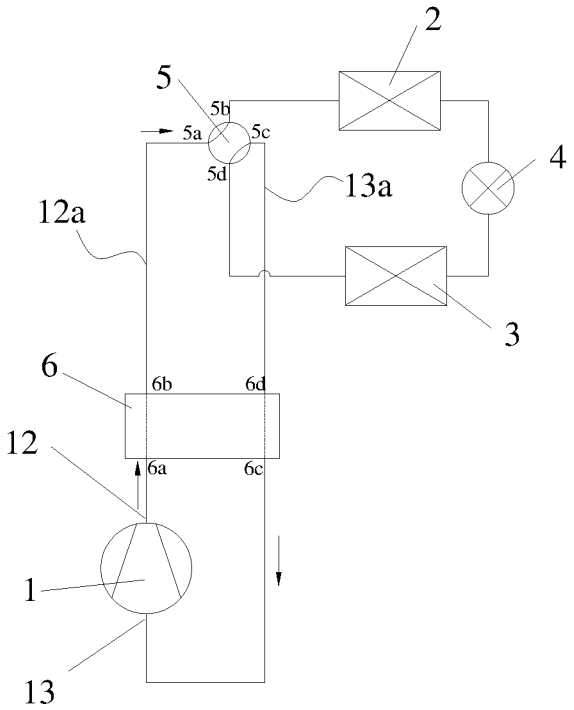
FIGS. 9 to 13 are schematic structural diagrams of a refrigeration device according to embodiments of the present disclosure.

As shown in FIGS. 6 to 8, the bypass valve 6 includes: a valve body 6*d*, a valve core 6*e* and an electromagnetic control portion 6*g*.

The valve body 6*d* defines a valve cavity. The first port 6*a*, the second port 6*b* and the third port 6*c* are all provided at the valve body 6*d* and communicated with the valve cavity. The valve core 6*e* is movably provided in the valve body 6*d*, and has a flow passage 6*f* which is always communicated with the first port 6*a* and selectively communicated with the second and third ports 6*b*, 6*c*. When the flow passage 6*f* is communicated with the second port 6*b*, the first port 6*a* is communicated with the second port 6*b*; when the flow passage 6*f* is communicated with the third port 6*c*, the first port 6*a* is communicated with the third port 6*c*.

At least part of the valve core 6*e* is movably provided in the valve body 6*d* in the axial direction of the valve body 6*d*, the first port 6*a* is provided at a first end portion (i.e., the left end in FIGS. 6 to 8) of the axial direction of the valve body 6*d*, the second port 6*b* is provided at a first side surface (i.e., the upper side surface in FIGS. 6 to 8) of the valve body 6*d*, the third port 6*c* is provided at a second side surface (i.e., the lower side surface in FIGS. 6 to 8) of the valve body 6*d*, and the flow passage 6*f* has a first open end facing the first end portion, a second open end facing the first side surface, and a third open end facing the second side surface. In some embodiments, the flow passage 6*f* includes a first section extending in the axial direction of the valve body 6*d* and a second section extending in the radial direction of the valve body 6*d*, the first section may be of a blind hole type, the second section may be of a through hole type, an open end of the first section serves as the first open end, and two ends of the second section serve as the second and third open ends which are opposed to the second and third ports 6*b*, 6*c* respectively when the valve core 6*e* is located at the position shown in FIG. 6. The first port 6*a* is communicated with the second port 6*b* when the second open end is opposed to the second port 6*b*; and the first port 6*a* is communicated with the third port 6*c* when the third open end is opposed to the third port 6*c*.

The electromagnetic control portion 6*g* is electromagnetically connected to the valve core 6*e*, the valve core 6*e* may include a control rod extending from a second end portion (i.e., the right end in FIGS. 6 to 8) of the axial direction of the valve body 6*d*, the electromagnetic control portion 6*g* is fitted over the control rod, the control rod is made of a ferromagnetic material, and when the electromagnetic control portion 6*g* is powered on, the control rod may be moved in the axial direction. The electromagnetic control portion 6*g* is electrically connected to the motor portion; that is, the electromagnetic control portion 6*g* may be controlled by an electric signal of the motor portion.

In some embodiments, the bypass valve 6 has a first state (a first operation mode) and a second state (a second operation mode). As shown in FIG. 6, in the first state, the first port 6*a* is communicated with the second port 6*b* and disconnected from the third port 6*c*; as shown in FIG. 7, in the second state, the first port 6*a* is communicated with the third port 6*c* and disconnected from the second port 6*b*. The compressor 1 is configured, such that the bypass valve 6 is switched from the first state to the second state when the motor portion is stopped from an operating state, and from the second state to the first state when the motor portion is started from the stopped state. That is, when the compressor 1 is started, the bypass valve 6 is automatically switched to the first state, facilitating air exhaust of the compressor 1 outwardly, and when the compressor 1 is stopped, the bypass valve 6 is automatically switched to the second state, facilitating the rapid pressure balance between the exhaust and suction sides of the compressor 1 to facilitate next rapid start.

In other embodiments, the bypass valve 6 has a first state, a second state and a third state: as shown in FIG. 6, in the first state, the first port 6*a* is communicated with the second port 6*b* and disconnected from the third port 6*c*; as shown in FIG. 7, in the second state, the first port 6*a* is communicated with the third port 6*c* and disconnected from the second port 6*b*; as shown in FIG. 8, in the third state, the first port 6*a* is disconnected from the second and third ports 6*b*, 6*c*. The compressor 1 is configured, such that the bypass valve 6 is switched from the first state to the second state when the motor portion is stopped from an operating state, and from the second state to the third state when the motor portion is started from the stopped state; when P1 is greater than or equal to P2, the bypass valve 6 is switched to the first state, and when P1 is less than P2, the bypass valve 6 remains in the third state when the motor portion is not stopped, and is switched to the second state when the motor portion is stopped, wherein P1 is the pressure at the first port 6*a*, and P2 is the pressure at the second port 6*b*. In this embodiment, since a pressure control signal is increased, an electric signal of the electromagnetic control portion 6*g* of the bypass valve 6 may be associated with a control signal of the motor portion, or controlled by providing a control unit independently.

In still other embodiments, the bypass valve 6 has a first state (a first operation mode), a second state (a second operation mode) and a third state (a third operation mode). As shown in FIG. 6, in the first state, the first port 6*a* is communicated with the second port 6*b* and disconnected from the third port 6*c*; as shown in FIG. 7, in the second state, the first port 6*a* is communicated with the third port 6*c* and disconnected from the second port 6*b*; as shown in FIG. 8, in the third state, the first port 6*a* is disconnected from the second and third ports 6*b*, 6*c*. The compressor 1 is configured, such that the bypass valve 6 is switched from the first state to the second state when the motor portion is stopped from an operating state, and from the second state to the third state when the motor portion is started from the stopped state, and after remaining in the third state for a preset time t, the bypass valve 6 is switched to the first state when the motor portion is not stopped, and to the second state when the motor portion is stopped, wherein t is greater than or equal to 1 second and less than or equal to 10 seconds, or greater than or equal to 2 seconds and less than or equal to 6 seconds.

Structures of two types of compressors 1 according to the embodiments of the present disclosure will be described below with reference to FIGS. 2 to 4.

Figure 2:
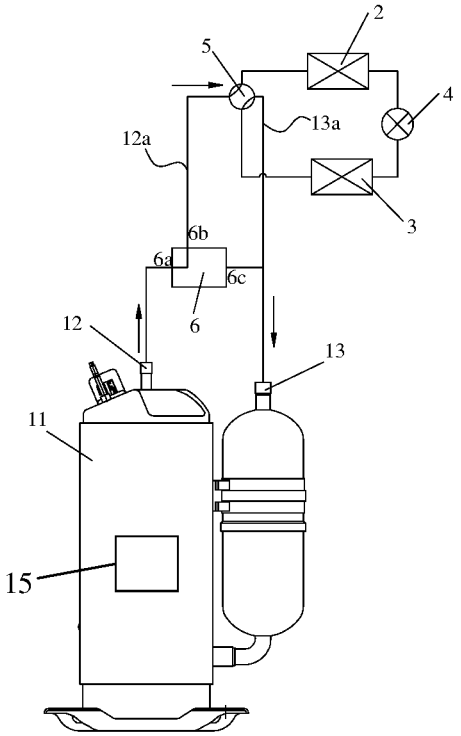
Figure 3:
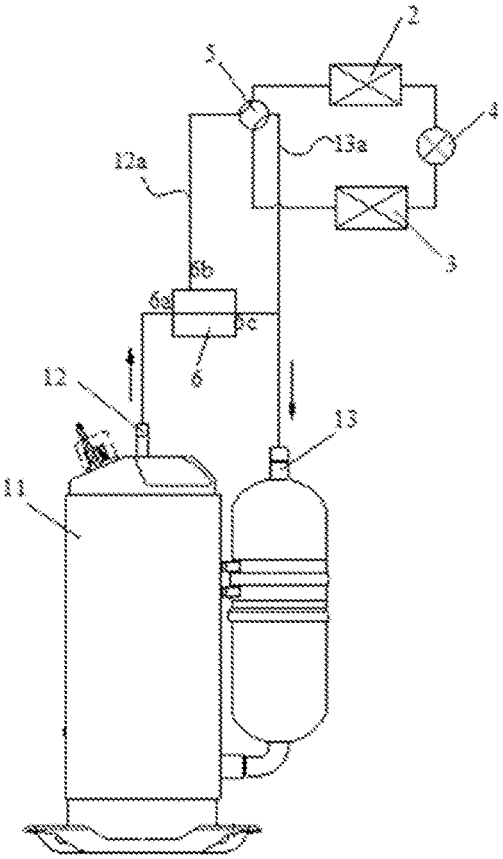

As shown in FIGS. 2 and 3, in some embodiments, the compressor 1 further includes a reservoir having an outlet communicated with an air inlet of the compressing mechanism portion, an air suction pipe 13 is provided at the reservoir, and the suction side includes the reservoir and the air suction pipe 13. The sealing container 11 defines a high-pressure containing cavity, an exhaust pipe 12 is provided at the sealing container 11, and the exhaust side includes the containing cavity and the exhaust pipe 12.

That is, the sealing container 11 encloses a high-pressure internal space, and is provided with the exhaust pipe 12 in communication with the high-pressure internal space, the internal space of the sealing container 11 and the exhaust pipe 12 together constitute the high-pressure side of the compressor 1, and the motor portion and the compressing mechanism portion are provided in the high-pressure internal space of the sealing container 11. The reservoir is provided outside the sealing container 11, has the outlet communicated with the air inlet of the compressing mechanism portion, and is provided with the air suction pipe 13 in communication with the suction-side pipeline 13*a* (low-pressure pipeline) of the refrigeration device, and the reservoir and the air suction pipe 13 jointly form the low-pressure side of the compressor 1.

The first port 6*a* of the bypass valve 6 is communicated with the high-pressure side of the compressor 1, the second port 6*b* of the bypass valve 6 is communicated with the exhaust-side pipeline 12*a* (high-pressure pipeline) of the refrigeration device, and the third port 6*c* of the bypass valve 6 is communicated with the suction side of the compressor 1 and the suction-side pipeline 13*a* (low-pressure pipeline) of the refrigeration device.

Figure 4:
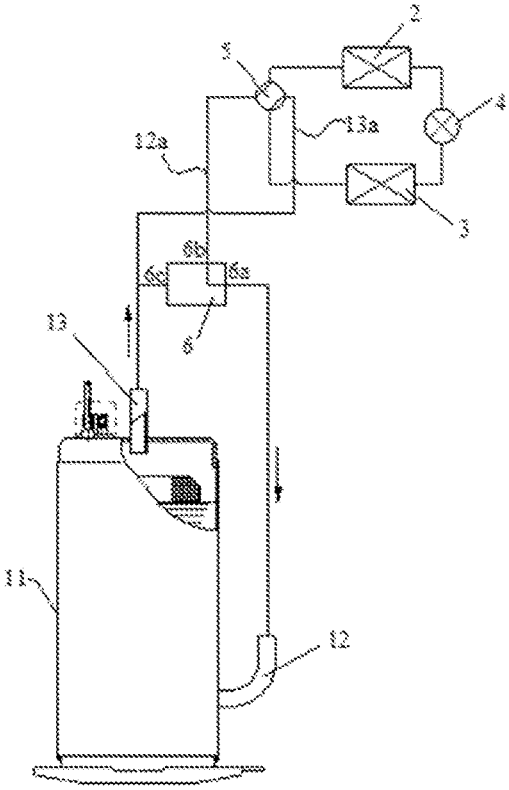

As shown in FIG. 4, in other embodiments, the sealing container 11 defines a low-pressure first cavity and a high-pressure second cavity, and is provided with an air suction pipe 13 in communication with the first cavity and an exhaust pipe 12 in communication with the second cavity, the suction side includes the first cavity and the air suction pipe 13, and the exhaust side includes the second cavity and the exhaust pipe 12.

That is, the sealing container 11 encloses a low-pressure internal space, and is provided with the air suction pipe 13 in communication with the low-pressure internal space, the air suction pipe 13 is communicated with the suction-side pipeline 13*a* (low-pressure pipeline) of the refrigeration device, and the low-pressure internal space and the air suction pipe 13 together constitute the low-pressure side of the compressor 1; the motor portion and the compressing mechanism portion are provided in the low-pressure internal space of the sealing container 11.

For example, in some exemplary embodiments, the internal space of the sealing container 11 is divided into two parts, i.e., a low-pressure internal space with a large volume and a high-pressure internal space with a small volume, and the compressing mechanism portion has one end located in the low-pressure internal space and the other end located in the high-pressure internal space; in this case, since the low-pressure internal space is large, it is still considered that the compressing mechanism portion is located in the low-pressure internal space, and the compressor 1 has the sealing container 11 with a low-pressure structure.

The compressor 1 having the sealing container 11 with the low-pressure structure further has a high-pressure exhaust cavity and an exhaust pipe 12, the high-pressure exhaust cavity is configured as a space for containing high-pressure gas compressed by the compressing mechanism portion to be hermetically separated from the low-pressure internal space, and the exhaust pipe 12 is communicated with the high-pressure exhaust cavity. For example, the high-pressure exhaust cavity may be provided in the internal space of the sealing container 11 or outside the sealing container 11. The high-pressure exhaust cavity and the exhaust pipe 12 together form the high-pressure side of the compressor 1.

The first port 6*a* of the bypass valve 6 is communicated with the high-pressure side of the compressor 1, the second port 6*b* of the bypass valve 6 is communicated with the exhaust-side pipeline 12*a* (high-pressure pipeline) of the refrigeration device, and the third port 6*c* of the bypass valve 6 is communicated with the suction side of the compressor 1 and the suction-side pipeline 13*a* (low-pressure pipeline) of the refrigeration device.

From the above description, in the compressor 1 according to the embodiments of the present disclosure, the dual effects of residual heat utilization and the rapid pressure balance of the system may be achieved at the same time only by adding one bypass valve 6. This solution is particularly suitable for occasions where the compressor is sensitive to the starting pressure difference and has large starting torque and a rapid restart requirement, is particularly effective for the application of a rotor compressor, and has the advantages of a low cost, a wide application range, and simple and reliable control.

A refrigeration device according to embodiments of the present disclosure will be described below with reference to FIGS. 1 to 8, which may be configured as an air conditioner, a refrigerator, or the like.

Figure 5:
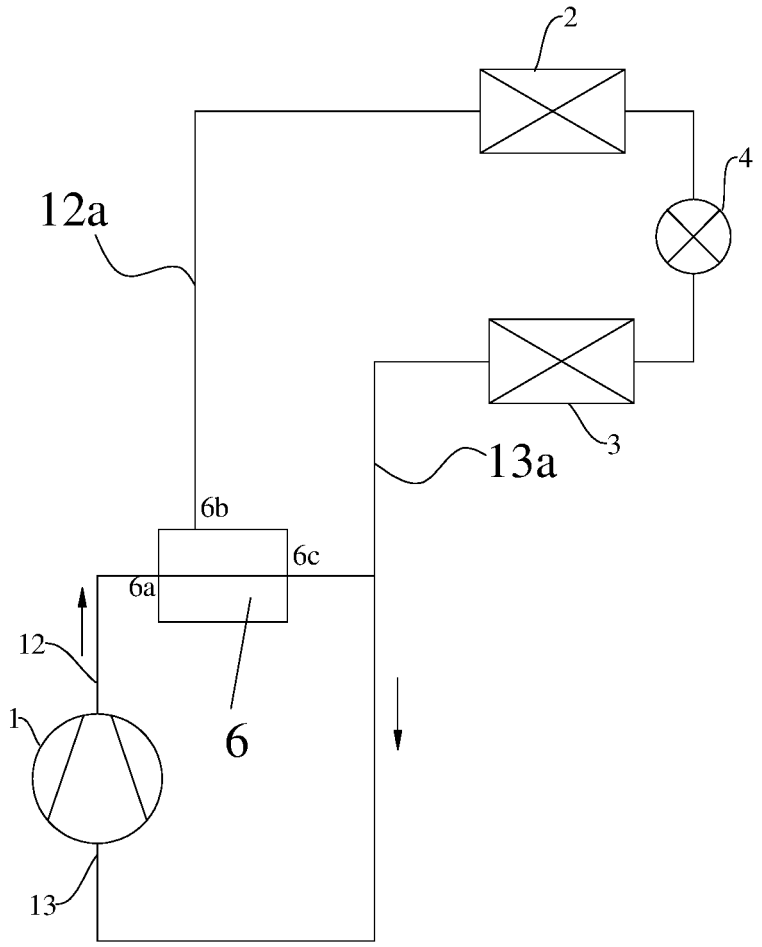

As shown in FIG. 5, a refrigeration device according to one embodiment of the present disclosure includes: a compressor 1, a first heat exchanger 2, a throttle valve 4, and a second heat exchanger 3, wherein the compressor 1 is the compressor 1 according to any one of the above-mentioned embodiments, a first connector of the first heat exchanger 2 is connected to the second port 6*b* of the bypass valve 6 and communicated therewith through an exhaust-side pipeline 12*a* (high-pressure pipeline), the throttle valve 4 is connected between a second connector of the first heat exchanger 2 and a first connector of the second heat exchanger 3, a second connector of the second heat exchanger 3 is connected to an air suction port of the compressor 1 and communicated therewith through a suction-side pipeline 13*a* (low-pressure pipeline), and the air suction port of the compressor 1 may be formed at an end portion of the air suction pipe 13 of the compressor 1.

The refrigeration device according to the embodiment of the present disclosure may be restarted rapidly, and residual heat may be utilized after the compressor 1 is stopped, with a high energy efficiency.

As shown in FIGS. 1 to 4, a refrigeration device according to another embodiment of the present disclosure includes: a compressor 1, a reversing device 5, a first heat exchanger 2, a throttle valve 4 and a second heat exchanger 3.

The reversing device 5 includes a first opening 5*a*, a second opening 5*b*, a third opening 5*c* and a fourth opening 5*d*, and may be configured as a four-way valve. The first opening 5*a* is connected to the second port 6*b*, the second opening 5*b* is connected to a first connector of the first heat exchanger 2 and communicated therewith through the exhaust-side pipeline 12*a* (high-pressure pipeline), the throttle valve 4 is connected between a second connector of the first heat exchanger 2 and a first connector of the second heat exchanger 3, a second connector of the second heat exchanger 3 is connected to the fourth opening 5*d*, the third opening 5*c* is connected to the air suction port of the compressor 1 and communicated therewith through the suction-side pipeline 13*a* (low-pressure pipeline), and the air suction port of the compressor 1 may be formed at an end portion of the air suction pipe 13 of the compressor 1.

When the first opening 5*a* is communicated with the second opening 5*b* and the third opening 5*c* is communicated with the fourth opening 5*d*, the first heat exchanger 2 serves as the high-pressure-side heat exchanger and the second heat exchanger 3 serves as the low-pressure-side heat exchanger. When the first opening 5*a* is communicated with the fourth opening 5*d* and the second opening 5*b* is communicated with the third opening 5*c*, the second heat exchanger 3 serves as the high-pressure-side heat exchanger and the first heat exchanger 2 serves as the low-pressure-side heat exchanger.

The compressor according to the embodiments of the present disclosure includes: a sealing container; a motor portion and a compressing mechanism portion provided in the sealing container; and a bypass valve including a first port, a second port and a third port, wherein the first port is selectively communicated with one of the second and third ports; the compressor has an exhaust side and a suction side which are spaced apart, the first port is communicated with the exhaust side, the third port is communicated with the suction side, and the exhaust side is suitable for exhausting air to external parts through the second port.

The compressor according to the embodiments of the present disclosure may be restarted rapidly, and residual heat may be utilized after the compressor is stopped, with a high energy efficiency.

In the compressor according to one embodiment of the present disclosure, the bypass valve includes: a valve body defining a valve cavity, the first, second and third ports being all provided in the valve body and communicated with the valve cavity; and a valve core movably provided in the valve body and provided with a flow passage, the flow passage being communicated with the first port and selectively communicated with the second and third ports.

In the compressor according to one embodiment of the present disclosure, at least part of the valve core is movably provided in the valve body in the axial direction of the valve body, the first port is provided at a first end portion of the axial direction of the valve body, the second port is provided at a first side surface of the valve body, the third port is provided at a second side surface of the valve body, and the flow passage has a first open end facing the first end portion, a second open end facing the first side surface, and a third open end facing the second side surface; the first port is communicated with the second port when the second open end is opposite to the second port; the first port is communicated with the third port when the third open end is opposite to the third port.

In the compressor according to one embodiment of the present disclosure, the bypass valve further includes an electromagnetic control portion electromagnetically connected to the valve core.

In the compressor according to one embodiment of the present disclosure, the bypass valve has a first state in which the first port is communicated with the second port and disconnected from the third port and a second state in which the first port is communicated with the third port and disconnected from the second port; the compressor is configured, such that the bypass valve is switched from the first state to the second state when the motor portion is stopped from an operating state, and from the second state to the first state when the motor portion is started from the stopped state.

In the compressor according to one embodiment of the present disclosure, the bypass valve has a first state in which the first port is communicated with the second port and disconnected from the third port, a second state in which the first port is communicated with the third port and disconnected from the second port, and a third state in which the first port is disconnected from the second and third ports.

The compressor according to one embodiment of the present disclosure is configured, such that the bypass valve is switched from the first state to the second state when the motor portion is stopped from an operating state, and from the second state to the third state when the motor portion is started from the stopped state; when P1 is greater than or equal to P2, the bypass valve is switched to the first state, and when P1 is less than P2, the bypass valve remains in the third state when the motor portion is not stopped, and is switched to the second state when the motor portion is stopped; P1 is the pressure at the first port, and P2 is the pressure at the second port.

The compressor according to one embodiment of the present disclosure is configured, such that the bypass valve is switched from the first state to the second state when the motor portion is stopped from the operating state, and from the second state to the third state when the motor portion is started from the stopped state, and after remaining in the third state for a preset time t, the bypass valve is switched to the first state when the motor portion is not stopped, and to the second state when the motor portion is stopped.

The compressor according to one embodiment of the present disclosure satisfies the condition that t is greater than or equal to 1 second and less than or equal to 10 seconds.

The compressor according to one embodiment of the present disclosure satisfies the condition that t is greater than or equal to 2 second and less than or equal to 6 seconds.

The compressor according to one embodiment of the present disclosure further includes a reservoir having an outlet communicated with an air inlet of the compressing mechanism portion, an air suction pipe being provided at the reservoir, and the suction side including the reservoir and the air suction pipe; the sealing container defining a high-pressure containing cavity, an exhaust pipe being provided at the sealing container, and the exhaust side including the containing cavity and the exhaust pipe.

In the compressor according to one embodiment of the present disclosure, the sealing container defines a low-pressure first cavity and a high-pressure second cavity, and is provided with an air suction pipe in communication with the first cavity and an exhaust pipe in communication with the second cavity, the suction side includes the first cavity and the air suction pipe, and the exhaust side includes the second cavity and the exhaust pipe.

The present disclosure further provides a refrigeration device, including: a first heat exchanger, a throttle valve, a second heat exchanger and the compressor according to any one of the above-mentioned embodiments, wherein a first connector of the first heat exchanger is connected to the second port, the throttle valve is connected between a second connector of the first heat exchanger and a first connector of the second heat exchanger, and a second connector of the second heat exchanger is connected to an air suction port of the compressor.

The present disclosure further provides a refrigeration device, including: a reversing device, a first heat exchanger, a throttle valve, a second heat exchanger and the compressor according to any one of the above-mentioned embodiments, wherein the reversing device includes a first opening, a second opening, a third opening and a fourth opening, the first opening is connected to the second port, the second opening is connected to a first connector of the first heat exchanger, the throttle valve is connected between a second connector of the first heat exchanger and a first connector of the second heat exchanger, a second connector of the second heat exchanger is connected to the fourth opening, and the third opening is connected to an air suction port of the compressor.

A compressor 1 according to the embodiments of the present disclosure will be described below with reference to FIGS. 9 to 16.

As shown in FIGS. 9 to 16, a compressor 1 according to one embodiment of the present disclosure includes: a sealing container 11, a motor portion, a compressing mechanism portion and a bypass valve 6.

The compressor 1 has an exhaust side and a suction side which are spaced apart, the exhaust side is configured as a high-pressure side, and the suction side is configured as a low-pressure side; the motor portion and the compressing mechanism portion are both provided in the sealing container 11, and the motor portion is configured to drive the compressing mechanism portion to realize air suction and compressed air exhaust; the bypass valve 6 includes a first port 6*a*, a second port 6*b*, a third port 6*c* and a fourth port 6*h*, the first port 6*a* may be selectively communicated with one of the second and third ports 6*b*, 6*c*, the fourth port 6*h* may be selectively communicated with the third port 6*c*, the first port 6*a* is communicated with the exhaust side of the compressor 1, the third port 6*c* is communicated with the suction side of the compressor 1, and when the first port 6*a* is communicated with the second port 6*b* and the third port 6*c* is communicated with the fourth port 6*h*, the exhaust side is suitable for exhausting air to external parts through the second port 6*b*, and the suction side is suitable for sucking air to the external parts through the fourth port 6*h*. In other words, the compressor is connected to an external pipeline through the second and fourth ports 6*b*, 6*h*, and when the first port 6*a* is disconnected from the second port 6*b*, the exhaust side of the compressor is disconnected from the external pipeline, and residual heat of a high-pressure-side heat exchanger may be used continuously.

When the compressor 1 is started to work normally, the motor portion works, the first and second ports 6*a*, 6*b* of the bypass valve 6 are communicated, the third and fourth ports 6*c*, 6*h* of the bypass valve 6 are communicated, and high-pressure gas output from the compressor 1 is output from the exhaust side to an exhaust-side pipeline 12*a* of a refrigeration device through the first and second ports 6*a*, 6*b*, and the suction side of the compressor 1 sucks air through a suction-side pipeline 13*a* as well as the fourth and third ports 6*h*, 6*c*.

When the compressor 1 stops operating, the motor portion does not work, the first and third ports 6*a*, 6*c* of the bypass valve 6 are communicated, the first port 6*a* is disconnected from the second port 6*b*, and the third port 6*c* is disconnected from the fourth port 6*h*. That is, the bypass valve 6 communicates the exhaust and suction sides of the compressor 1, and disconnects the exhaust side of the compressor 1 from other components of the refrigeration device.

Thus, when the compressor 1 is stopped, the pressures on the exhaust and suction sides of the compressor 1 may be balanced quickly, facilitating quick restart of the compressor 1.

On the other hand, when the compressor 1 is stopped, the bypass valve 6 cuts off the communication between the exhaust side of the compressor 1 and the refrigeration device, backflow from the second port 6*b* to the first port 6*a* is unable to be realized, the interior of the high-pressure-side heat exchanger is kept in a high pressure state, and the throttle valve 4 still has a certain flow rate under the action of a pressure difference, such that the residual heat of the high-pressure-side heat exchanger may be still released, and a low-pressure-side heat exchanger still has the capacity of heat absorption by evaporation; thus, when the compressor 1 is stopped, the refrigeration device is still able to utilize the residual heat in the heat exchanger, thereby improving the overall efficiency of the refrigeration device and realizing utilization of the residual heat of a system, with the advantages of simplicity, reliability, high efficiency and energy conservation.

In the present disclosure, after the compressor 1 is stopped, the bypass valve 6 disconnects the high-pressure side of the compressor from the high-pressure side heat exchanger and directly communicates the high-pressure side to the low-pressure side of the compressor, the high-pressure side of the compressor has a small volume, and the bypass valve 6 has a direct communication channel, such that the high-pressure and low-pressure sides of the compressor 1 may realize a pressure balance rapidly to meet the requirement that the pressure difference when the compressor is started is less than 1 kgf/cm$^2$, thereby achieving the function of quick restart after the compressor is stopped. According to the size of a bypass channel of the selected bypass valve 6, pressure balance time obtained by the inventor through a large number of experimental tests may meet the requirement of the rapidest pressure balance within 1 minute.

From the above description, in the compressor 1 according to the embodiments of the present disclosure, the dual effects of residual heat utilization and the rapid pressure balance of the system may be achieved at the same time only by adding one bypass valve 6, and this solution is particularly suitable for occasions where the compressor is sensitive to the starting pressure difference and has large starting torque and a rapid restart requirement, is particularly effective for the application of a rotor compressor, and has the advantages of a low cost, a wide application range, and simple and reliable control.

The compressor 1 according to the embodiment of the present disclosure may be restarted rapidly, and the residual heat may be utilized after the compressor 1 is stopped, with a high energy efficiency.

The structure of the bypass valve 6 according to embodiments of the present disclosure will be described below with reference to FIGS. 14 to 16.

Figure 14:
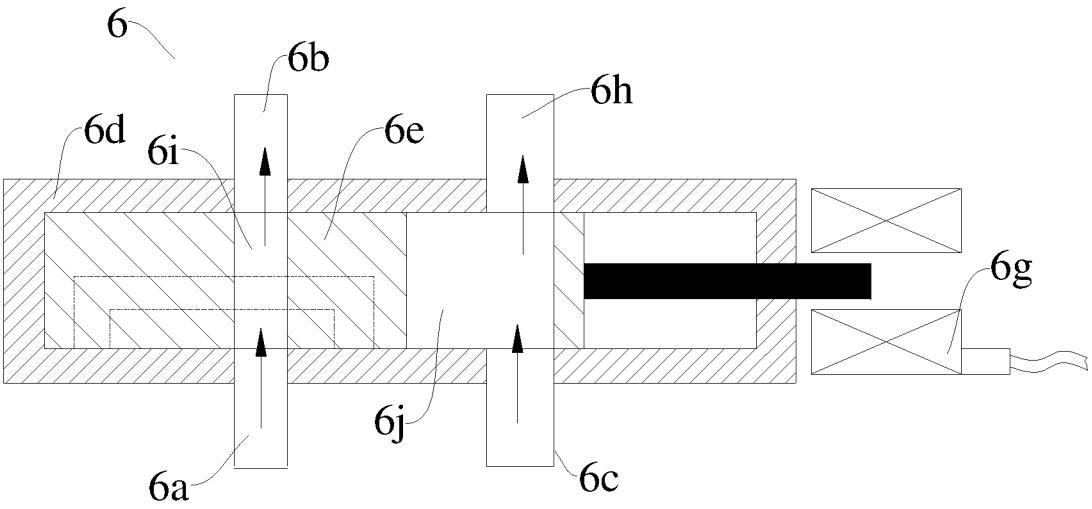
FIG. 14 is a schematic structural diagram of a bypass valve according to embodiments of the present disclosure in a first state.
Figure 15:
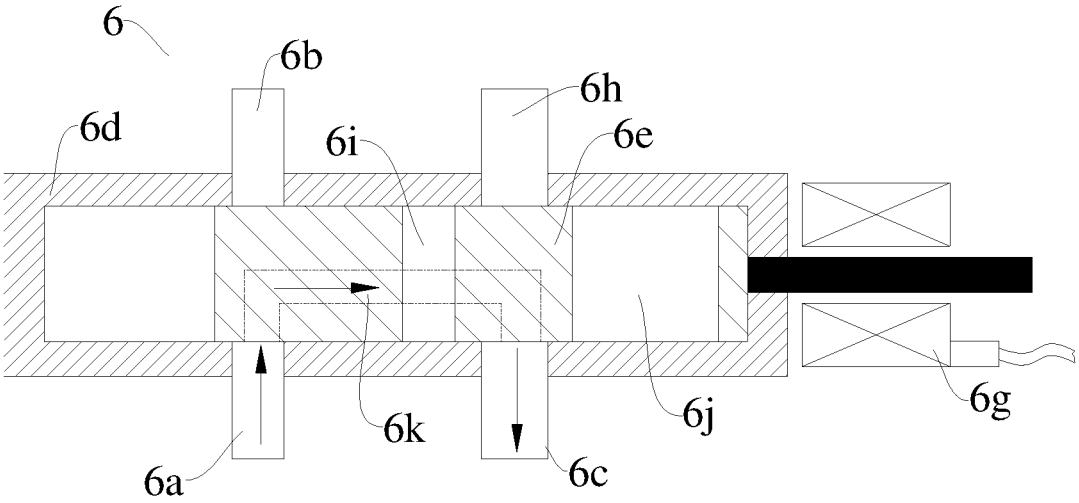
FIG. 15 is a schematic structural diagram of the bypass valve according to the embodiments of the present disclosure in a second state.
Figure 16:
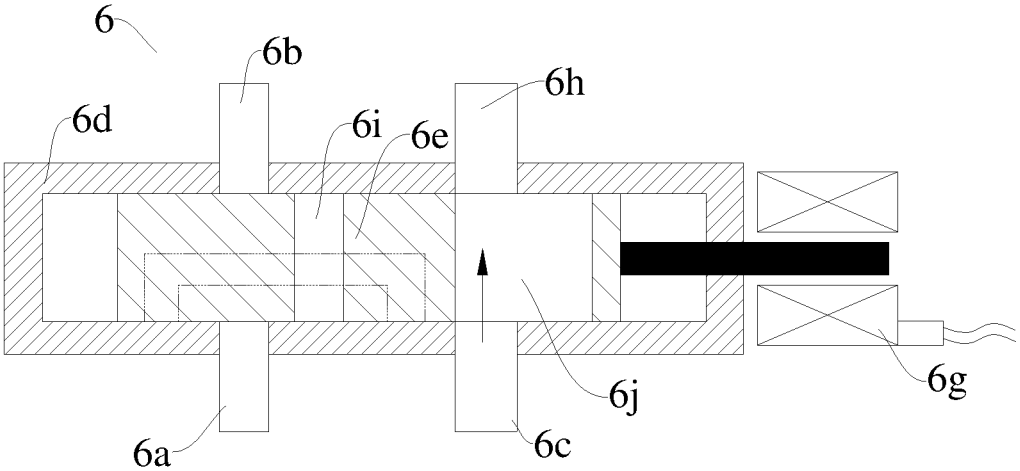
FIG. 16 is a schematic structural diagram of the bypass valve according to the embodiments of the present disclosure in a third state.

As shown in FIGS. 14 to 16, the bypass valve 6 includes: a valve body 6*d*, a valve core 6*e* and an electromagnetic control portion 6*g*.

The valve body 6*d* defines a valve cavity, and a first port 6*a*, a second port 6*b*, a third port 6*c* and a fourth port 6*h* are all provided at the valve body 6*d* and communicated with the valve cavity.

The valve core 6*e* is movably provided in the valve body 6*d*, and has a first flow passage 6*i*, a second flow passage 6*j* and a third flow passage 6*k*, the first and second ports 6*a*, 6*b* are suitable for being communicated through the first flow passage 6*i*, and the third and fourth ports 6*c*, 6*h* are suitable for being communicated through the second flow passage 6*j*, or the first and third ports 6*a*, 6*c* are suitable for being communicated through the third flow passage 6*k*.

At least part of the valve core 6*e* is movably provided in the valve body 6*d* in the axial direction (i.e., the left-right direction in FIGS. 14 to 16) of the valve body 6*d*, the first and third ports 6*a*, 6*c* are provided at a first side surface (i.e., the lower side surface in FIGS. 14 to 16) of the valve body 6*d* and spaced apart in the axial direction, the second and fourth ports 6*b*, 6*h* are provided at a second side surface (i.e., the upper side surface in FIGS. 14 to 16) of the valve body 6*d* and spaced apart in the axial direction, the first port 6*a* may be provided opposite to the second port 6*b*, and the third port 6*c* may be provided opposite to the fourth port 6*h*.

Two open ends of the first flow passage 6*i* face the first and second side surfaces of the valve body 6*d* respectively, two open ends of the second flow passage 6*j* face the first and second side surfaces of the valve body 6*d* respectively, and two open ends of the third flow passage 6*k* face the first side surface of the valve body 6*d*.

The first and second flow passages 6*i*, 6*j* are spaced apart in the axial direction of the valve core 6*e*, and the width of the second flow passage 6*j* in the axial direction of the valve core 6*e* is greater than the width of the first flow passage 6*i* in the axial direction of the valve core 6*e*, such that the third and fourth ports 6*c*, 6*h* may be kept in communication when the first port 6*a* is disconnected from the second port 6*b*.

In some embodiments, the first and second flow passages 6*i*, 6*j* penetrate through the valve core 6*e* in the radial direction thereof, the third flow passage 6*k* includes a first section extending in the axial direction of the valve core 6*e* and two second sections extending in the radial direction of the valve core 6*e*, and the two second sections are connected to two ends of the first section respectively, and have open ends opposite to the first section.

The electromagnetic control portion 6*g* is electromagnetically connected to the valve core 6*e*, the valve core 6*e* may include a control rod extending from a second end portion (i.e., the right end in FIGS. 14 to 16) of the axial direction of the valve body 6*d*, the electromagnetic control portion 6*g* is fitted over the control rod, the control rod is made of a ferromagnetic material, and when the electromagnetic control portion 6*g* is powered on, the control rod may be moved in the axial direction. The electromagnetic control portion 6*g* is electrically connected to the motor portion; that is, the electromagnetic control portion 6*g* may be controlled by an electric signal of the motor portion.

In some embodiments, the bypass valve 6 has a first state and a second state: as shown in FIG. 14, in the first state, the first port 6*a* is communicated with the second port 6*b*, and the fourth port 6*h* is communicated with the third port 6*c*; as shown in FIG. 15, in the second state, the first port 6*a* is communicated with the third port 6*c* and disconnected from the second port 6*b*, and the third port 6*c* is disconnected from the fourth port 6*h*. The compressor 1 is configured, such that the bypass valve 6 is switched from the first state to the second state when the motor portion is stopped from an operating state, and from the second state to the first state when the motor portion is started from the stopped state. That is, when the compressor 1 is started, the bypass valve 6 is automatically switched to the first state, facilitating outward air exhaust and air suction of the compressor 1, and when the compressor 1 is stopped, the bypass valve 6 is automatically switched to the second state, facilitating the rapid pressure balance between the exhaust and suction sides of the compressor 1 to facilitate next rapid start.

In other embodiments, the bypass valve 6 has a first state, a second state and a third state: as shown in FIG. 14, in the first state, the first port 6*a* is communicated with the second port 6*b*, and the fourth port 6*h* is communicated with the third port 6*c*; as shown in FIG. 15, in the second state, the first port 6*a* is communicated with the third port 6*c* and disconnected from the second port 6*b*, and the third port 6*c* is disconnected from the fourth port 6*h*; as shown in FIG. 16, in the third state, the first port 6*a* is disconnected from the second port 6*b*, and the fourth port 6*h* is communicated with the third port 6*c*. The compressor 1 is configured, such that the bypass valve 6 is switched from the first state to the second state when the motor portion is stopped from an operating state, and from the second state to the third state when the motor portion is started from the stopped state; when P1 is greater than or equal to P2, the bypass valve 6 is switched to the first state, and when P1 is less than P2, the bypass valve 6 remains in the third state when the motor portion is not stopped, and is switched to the second state when the motor portion is stopped; P1 is the pressure at the first port 6*a*, and P2 is the pressure at the second port 6*b*. In this embodiment, since a pressure control signal is increased, an electric signal of the electromagnetic control portion 6*g* of the bypass valve 6 may be associated with a control signal of the motor portion, or controlled by providing a control unit independently.

In still other embodiments, the bypass valve 6 has a first state, a second state and a third state: as shown in FIG. 14, in the first state, the first port 6*a* is communicated with the second port 6*b*, and the fourth port 6*h* is communicated with the third port 6*c*; as shown in FIG. 15, in the second state, the first port 6*a* is communicated with the third port 6*c* and disconnected from the second port 6*b*, and the third port 6*c* is disconnected from the fourth port 6*h*; as shown in FIG. 16, in the third state, the first port 6*a* is disconnected from the second port 6*b*, and the fourth port 6*h* is communicated with the third port 6*c*. The compressor 1 is configured, such that the bypass valve 6 is switched from the first state to the second state when the motor portion is stopped from an operating state, and from the second state to the third state when the motor portion is started from the stopped state, and after remaining in the third state for a preset time t, the bypass valve 6 is switched to the first state when the motor portion is not stopped, and to the second state when the motor portion is stopped; t is greater than or equal to 1 second and less than or equal to 10 seconds, or greater than or equal to 2 seconds and less than or equal to 6 seconds.

Structures of two types of compressors 1 according to the embodiments of the present disclosure will be described below with reference to FIGS. 10 to 12.

Figure 10:
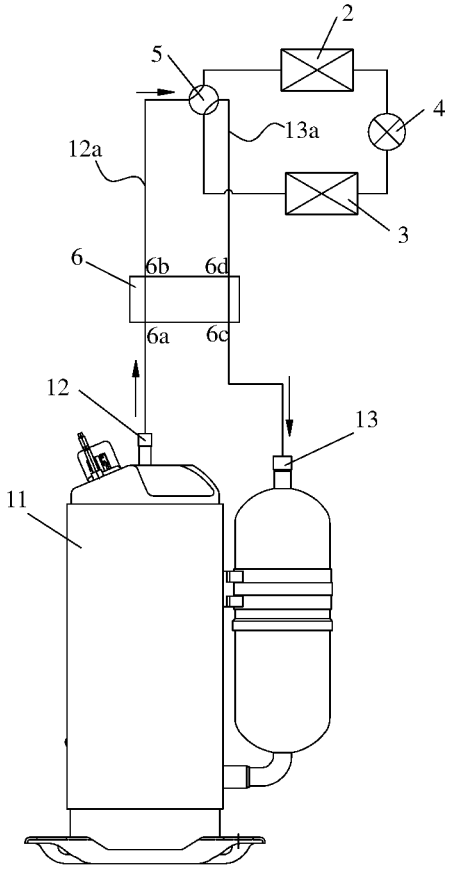
Figure 11:
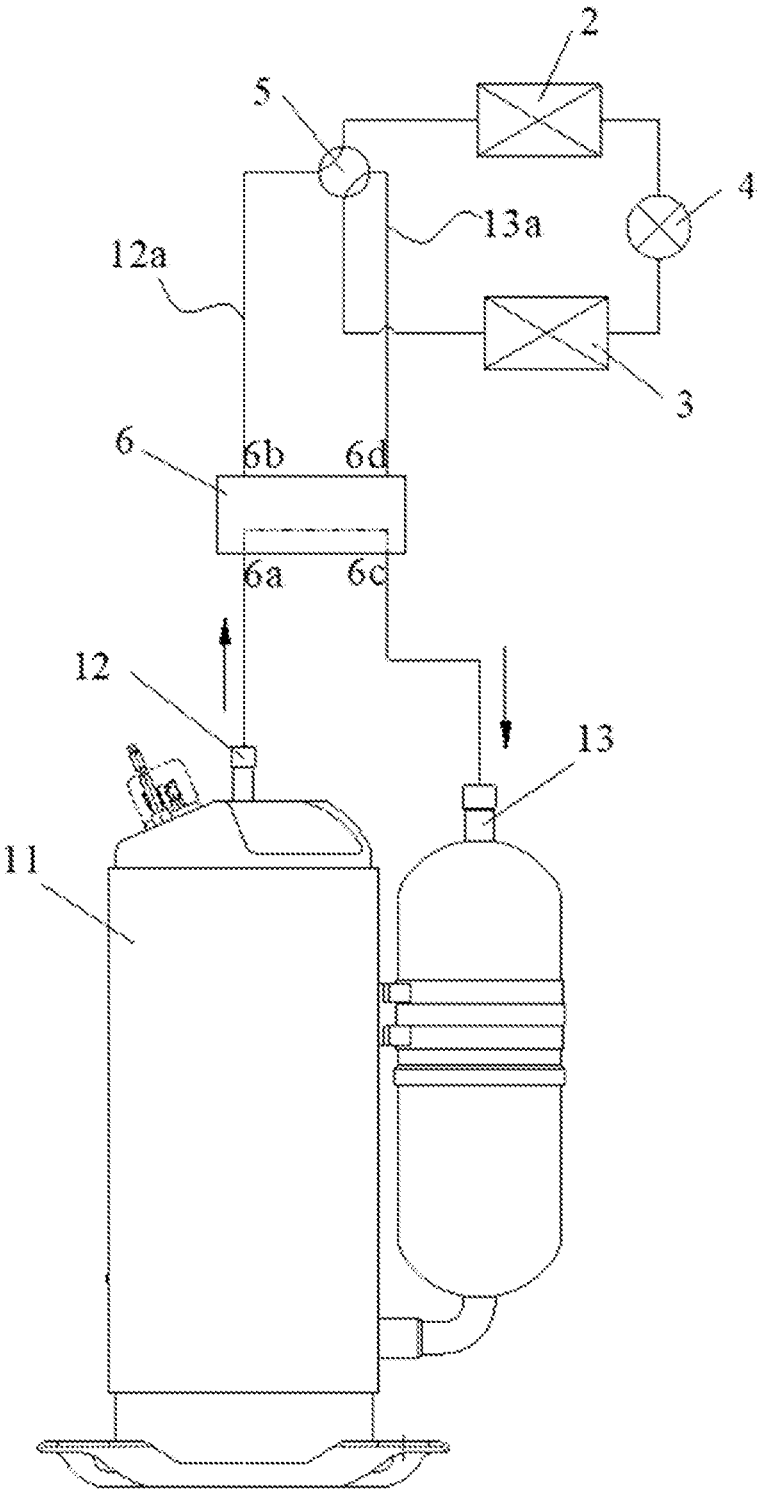

As shown in FIGS. 10 and 11, in some embodiments, the compressor 1 further includes a reservoir having an outlet communicated with an air inlet of the compressing mechanism portion, an air suction pipe 13 is provided at the reservoir, and the suction side includes the reservoir and the air suction pipe 13; the sealing container 11 defines a high-pressure containing cavity, an exhaust pipe 12 is provided at the sealing container 11, and the exhaust side includes the containing cavity and the exhaust pipe 12.

That is, the sealing container 11 encloses a high-pressure internal space, and is provided with the exhaust pipe 12 in communication with the high-pressure internal space, the internal space of the sealing container 11 and the exhaust pipe 12 together constitute the high-pressure side of the compressor 1, and the motor portion and the compressing mechanism portion are provided in the high-pressure internal space of the sealing container 11; the reservoir is provided outside the sealing container 11, has the outlet communicated with the air inlet of the compressing mechanism portion, and is provided with the air suction pipe 13 in communication with the suction-side pipeline 13*a* (low-pressure pipeline) of the refrigeration device, and the reservoir and the air suction pipe 13 jointly form the low-pressure side of the compressor 1.

The first port 6*a* of the bypass valve 6 is communicated with the high-pressure side of the compressor 1, the second port 6*b* of the bypass valve 6 is communicated with the exhaust-side pipeline 12*a* (high-pressure pipeline) of the refrigeration device, the third port 6*c* of the bypass valve 6 is communicated with the suction side of the compressor 1, and the fourth port 6*h* of the bypass valve 6 is communicated with the suction-side pipeline 13*a* (low-pressure pipeline) of the refrigeration device.

Figure 12:
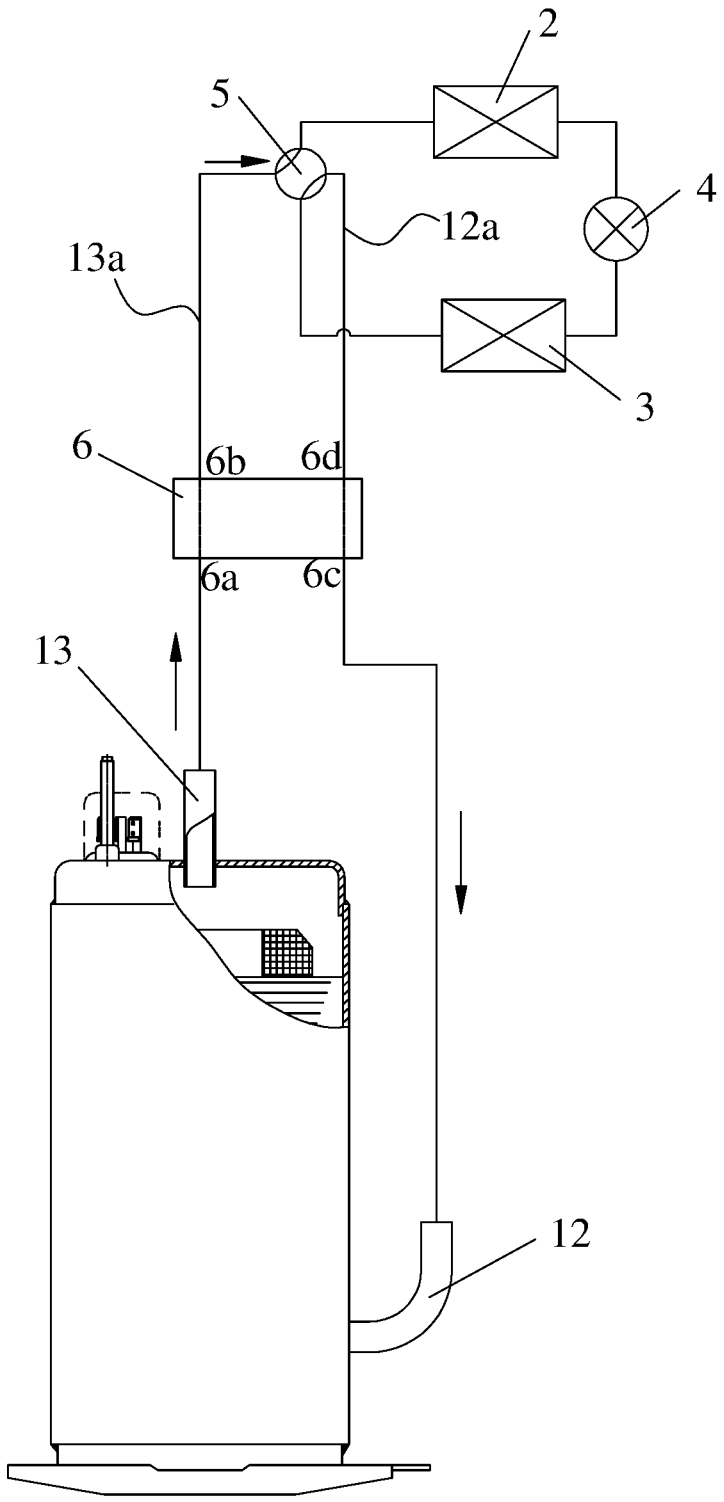

As shown in FIG. 12, in other embodiments, the sealing container 11 defines a low-pressure first cavity and a high-pressure second cavity, and is provided with an air suction pipe 13 in communication with the first cavity and an exhaust pipe 12 in communication with the second cavity, the suction side includes the first cavity and the air suction pipe 13, and the exhaust side includes the second cavity and the exhaust pipe 12.

That is, the sealing container 11 encloses a low-pressure internal space, and is provided with the air suction pipe 13 in communication with the low-pressure internal space, the air suction pipe 13 is communicated with the suction-side pipeline 13*a* (low-pressure pipeline) of the refrigeration device, and the low-pressure internal space and the air suction pipe 13 together constitute the low-pressure side of the compressor 1; the motor portion and the compressing mechanism portion are provided in the low-pressure internal space of the sealing container 11.

In some embodiments, the internal space of the sealing container 11 is divided into two parts, i.e., a low-pressure internal space with a large volume and a high-pressure internal space with a small volume, and the compressing mechanism portion has one end located in the low-pressure internal space and the other end located in the high-pressure internal space; in this case, since the low-pressure internal space is large, it is still considered that the compressing mechanism portion is located in the low-pressure internal space, and the compressor 1 has the sealing container 11 with a low-pressure structure.

The compressor 1 having the sealing container 11 with the low-pressure structure further has a high-pressure exhaust cavity and an exhaust pipe 12, the high-pressure exhaust cavity is configured as a space for containing high-pressure gas compressed by the compressing mechanism portion to be hermetically separated from the low-pressure internal space, and the exhaust pipe 12 is communicated with the high-pressure exhaust cavity. In practical designs, the high-pressure exhaust cavity may be provided in the internal space of the sealing container 11 or outside the sealing container 11. The high-pressure exhaust cavity and the exhaust pipe 12 together form the high-pressure side of the compressor 1.

The first port 6*a* of the bypass valve 6 is communicated with the high-pressure side of the compressor 1, the second port 6*b* of the bypass valve 6 is communicated with the exhaust-side pipeline 12*a* (high-pressure pipeline) of the refrigeration device, the third port 6*c* of the bypass valve 6 is communicated with the suction side of the compressor 1, and the fourth port 6*h* of the bypass valve 6 is communicated with the suction-side pipeline 13*a* (low-pressure pipeline) of the refrigeration device.

From the above description, in the compressor 1 according to the embodiments of the present disclosure, the dual effects of residual heat utilization and the rapid pressure balance of the system may be achieved at the same time only by adding one bypass valve 6. This solution is particularly suitable for occasions where the compressor is sensitive to the starting pressure difference and has large starting torque and a rapid restart requirement, is particularly effective for the application of a rotor compressor, and has the advantages of a low cost, a wide application range, and simple and reliable control.

A refrigeration device according to embodiments of the present disclosure will be described below with reference to FIGS. 9 to 16, which may be configured as an air conditioner, a refrigerator, or the like.

Figure 13:
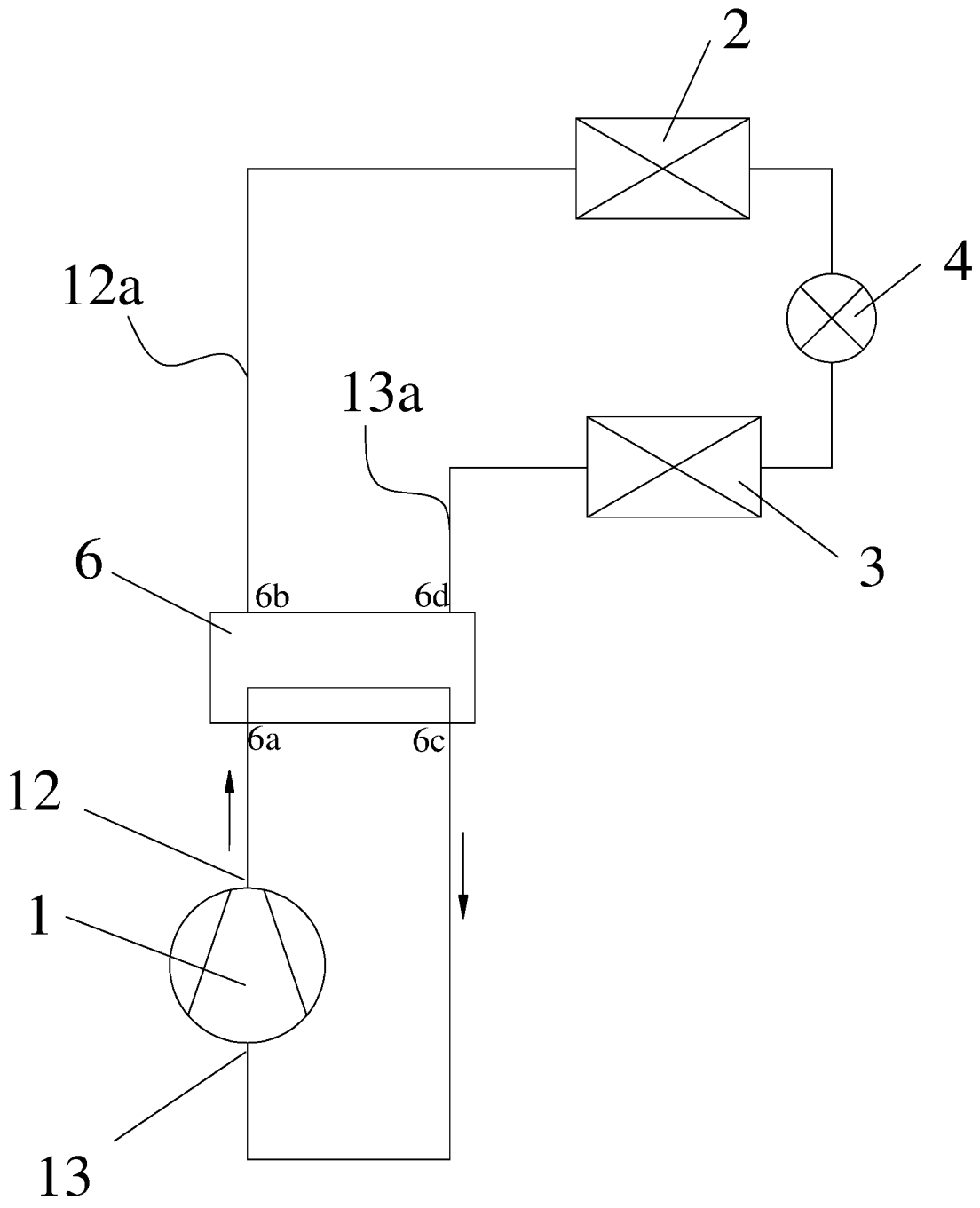

As shown in FIG. 13, a refrigeration device according to one embodiment of the present disclosure includes: a compressor 1, a first heat exchanger 2, a throttle valve 4, and a second heat exchanger 3, wherein the compressor 1 is the compressor 1 according to any one of the above-mentioned embodiments, a first connector of the first heat exchanger 2 is connected to the second port 6*b* of the bypass valve 6 and communicated therewith through an exhaust-side pipeline 12*a* (high-pressure pipeline), the throttle valve 4 is connected between a second connector of the first heat exchanger 2 and a first connector of the second heat exchanger 3, a second connector of the second heat exchanger 3 is connected to the fourth port 6*h* and communicated therewith through a suction-side pipeline 13*a* (low-pressure pipeline), and the fourth port 6*h* may serve as the air suction port of the compressor 1.

The refrigeration device according to the embodiment of the present disclosure may be restarted rapidly, and residual heat may be utilized after the compressor 1 is stopped, with a high energy efficiency.

As shown in FIGS. 9 to 12, a refrigeration device according to another embodiment of the present disclosure includes: a compressor 1, a reversing device 5, a first heat exchanger 2, a throttle valve 4 and a second heat exchanger 3.

The reversing device 5 includes a first opening 5*a*, a second opening 5*b*, a third opening 5*c* and a fourth opening 5*d*, and may be configured as a four-way valve; the first opening 5*a* is connected to the second port 6*b*, the second opening 5*b* is connected to a first connector of the first heat exchanger 2 and communicated therewith through the exhaust-side pipeline 12*a* (high-pressure pipeline), the throttle valve 4 is connected between a second connector of the first heat exchanger 2 and a first connector of the second heat exchanger 3, a second connector of the second heat exchanger 3 is connected to the fourth opening 5*d*, the third opening 5*c* is connected to the fourth port 6*h* and communicated therewith through the suction-side pipeline 13*a* (low-pressure pipeline), and the fourth port 6*h* may serve as the air suction port of the compressor 1.

When the first port 5*a* is communicated with the second port 5*b*, and the third port 5*c* is communicated with the fourth port 5*d*, the first heat exchanger 2 is a high-pressure side heat exchanger, and the second heat exchanger 3 is a low-pressure side heat exchanger. When the first port 5*a* is communicated with the fourth port 5*d* and the second port 5*b* is communicated with the third port 5*c*, the second heat exchanger 3 is a high-pressure side heat exchanger and the first heat exchanger 2 is a low-pressure side heat exchanger.

The compressor according to the embodiments of the present disclosure includes: a sealing container; a motor portion and a compressing mechanism portion provided in the sealing container; and a bypass valve including a first port, a second port, a third port and a fourth port, the first port is selectively communicated with one of the second and third ports, and the fourth port is selectively communicated with the third port; the compressor has an exhaust side and a suction side which are spaced apart, the first port is communicated with the exhaust side, the third port is communicated with the suction side, and when the first port is communicated with the second port and the third port is communicated with the fourth port, the exhaust side is suitable for exhausting air to external parts through the second port, and the suction side is suitable for sucking air to the external parts through the fourth port.

The compressor according to the embodiments of the present disclosure may be restarted rapidly, and residual heat may be utilized after the compressor is stopped, with a high energy efficiency.

In the compressor according to one embodiment of the present disclosure, the bypass valve includes: a valve body defining a valve cavity, the first, second, third and fourth ports being all provided at the valve body and communicated with the valve cavity; and a valve core movably provided in the valve body, the valve core having a first flow passage, a second flow passage and a third flow passage, the first and second ports being suitable for being communicated through the first flow passage, and the third and fourth ports being suitable for being communicated through the second flow passage, or the first and third ports being suitable for being communicated through the third flow passage.

In the compressor according to one embodiment of the present disclosure, at least part of the valve core is movably provided in the valve body in the axial direction of the valve body, the first and third ports are provided at the first side surface of the valve body and spaced apart in the axial direction, the second and fourth ports are provided at the second side surface of the valve body and spaced apart in the axial direction, two open ends of the first flow passage and two open ends of the second flow passage face the first and second side surfaces of the valve body respectively, and two open ends of the third flow passage face the first side surface of the valve body.

In the compressor according to one embodiment of the present disclosure, the first and second flow passages are spaced apart in the axial direction of the valve core, and the width of the second flow passage in the axial direction of the valve core is greater than the width of the first flow passage in the axial direction of the valve core.

In the compressor according to one embodiment of the present disclosure, the bypass valve further includes an electromagnetic control portion electromagnetically connected to the valve core.

In the compressor according to one embodiment of the present disclosure, the bypass valve has a first state in which the first port is communicated with the second port and the fourth port is communicated with the third port and a second state in which the first port is communicated with the third port and disconnected from the second port, and the third port is disconnected from the fourth port. The compressor is configured, such that the bypass valve is switched from the first state to the second state when the motor portion is stopped from an operating state, and from the second state to the first state when the motor portion is started from the stopped state.

In the compressor according to one embodiment of the present disclosure, the bypass valve has a first state in which the first port is communicated with the second port and the fourth port is communicated with the third port, a second state in which the first port is communicated with the third port and disconnected from the second port and the third port is disconnected from the fourth port, and a third state in which the first port is disconnected from the second port and the fourth port is communicated with the third port.

The compressor according to one embodiment of the present disclosure is configured, such that the bypass valve is switched from the first state to the second state when the motor portion is stopped from an operating state, and from the second state to the third state when the motor portion is started from the stopped state; when P1 is greater than or equal to P2, the bypass valve is switched to the first state, and when P1 is less than P2, the bypass valve remains in the third state when the motor portion is not stopped, and is switched to the second state when the motor portion is stopped; P1 is the pressure at the first port, and P2 is the pressure at the second port.

The compressor according to one embodiment of the present disclosure is configured, such that the bypass valve is switched from the first state to the second state when the motor portion is stopped from the operating state, and from the second state to the third state when the motor portion is started from the stopped state, and after remaining in the third state for a preset time t, the bypass valve is switched to the first state when the motor portion is not stopped, and to the second state when the motor portion is stopped.

The compressor according to one embodiment of the present disclosure satisfies the condition that t is greater than or equal to 1 second and less than or equal to 10 seconds.

The compressor according to one embodiment of the present disclosure further includes a reservoir having an outlet communicated with an air inlet of the compressing mechanism portion, an air suction pipe being provided at the reservoir, and the suction side including the reservoir and the air suction pipe; the sealing container defining a high-pressure containing cavity, an exhaust pipe being provided at the sealing container, and the exhaust side including the containing cavity and the exhaust pipe.

In the compressor according to one embodiment of the present disclosure, the sealing container defines a low-pressure first cavity and a high-pressure second cavity, and is provided with an air suction pipe in communication with the first cavity and an exhaust pipe in communication with the second cavity, the suction side includes the first cavity and the air suction pipe, and the exhaust side includes the second cavity and the exhaust pipe.

The present disclosure further provides a refrigeration device, including: a first heat exchanger, a throttle valve, a second heat exchanger and the compressor according to any one of the above-mentioned embodiments, wherein a first connector of the first heat exchanger is connected to the second port, the throttle valve is connected between a second connector of the first heat exchanger and a first connector of the second heat exchanger, and a second connector of the second heat exchanger is connected to the fourth port.

The present disclosure further provides a refrigeration device, including: a reversing device, a first heat exchanger, a throttle valve, a second heat exchanger and the compressor according to any one of the above-mentioned embodiments, wherein the reversing device includes a first opening, a second opening, a third opening and a fourth opening, the first opening is connected to the second port, the second opening is connected to a first connector of the first heat exchanger, the throttle valve is connected between a second connector of the first heat exchanger and a first connector of the second heat exchanger, a second connector of the second heat exchanger is connected to the fourth opening, and the third opening is connected to the fourth port.

What is claimed is:

1. A compressor comprising:

a sealing container;

a motor portion and a compressing mechanism portion, both provided in the sealing container; and a bypass valve;

wherein the compressor comprises an exhaust side and a suction side spaced apart from each other, the exhaust side is connected to the bypass valve, and the exhaust side is configured to exhaust air to external parts through the bypass valve or communicate with the suction side through the bypass valve, wherein the bypass valve comprises a valve body defining a valve cavity, the valve body comprising a plurality of ports in communication with the valve cavity, and the plurality of ports being configured to be connected to the exhaust side, the suction side and the external parts respectively; and a valve core movably provided in the valve body and having at least one flow passage, the plurality of ports being selectively communicated with one another through the at least one flow passage, and wherein:

the plurality of ports comprise a first port, a second port and a third port;

the first port is selectively communicated with only one of the second port and the third port;

the first port is communicated with the exhaust side;

the third port is communicated with the suction side; and the exhaust side is configured to exhaust air to the external parts through the second port, wherein:

the bypass valve has a first state, a second state and a third state; and in the first state, the exhaust side is communicated with the external parts through the bypass valve and disconnected from the suction side, in the second state, the exhaust side is disconnected from the external parts and communicated with the suction side through the bypass valve, and in the third state, the exhaust side is disconnected from the external parts and the suction side, and wherein:

the compressor is configured, such that the bypass valve is switched from the first state to the second state when the motor portion is stopped from an operating state;

the compressor is configured, such that the bypass valve is switched from the second state to the third state when the motor portion is started from a stopped state; and when P1 is greater than or equal to P2, the bypass valve is switched to the first state, and when the P1 is less than the P2, the bypass valve remains in the third state when the motor portion is not stopped, and is switched to the second state when the motor portion is stopped, wherein the P1 is a pressure at a first port, and the P2 is a pressure at a second port.

2. The compressor according to claim 1, wherein the bypass valve further comprises an electromagnetic control portion electromagnetically connected to the valve core.

3. The compressor according to claim 1, wherein:

at least part of the valve core is movably provided in the valve body in an axial direction of the valve body;

the first port is provided at a first end portion of the axial direction of the valve body;

the second port is provided at a first side surface of the valve body;

the third port is provided at a second side surface of the valve body;

the flow passage has a first open end facing the first end portion, a second open end facing the first side surface, and a third open end facing the second side surface; and the first port is communicated with the second port when the second open end is opposite to the second port and the first port is communicated with the third port when the third open end is opposite to the third port.

4. The compressor according to claim 1, wherein:

the plurality of ports comprise a first port, a second port, a third port and a fourth port;

the first port is selectively communicated with one of the second port and the third port;

the fourth port is selectively communicated with the third port;

the first port is communicated with the exhaust side;

the third port is communicated with the suction side; and when the first port is communicated with the second port and the third port is communicated with the fourth port, the exhaust side is configured to exhaust air to the external parts through the second port and the suction side is configured to suck air to the external parts through the fourth port.

5. The compressor according to claim 1, wherein:

the bypass valve comprises a first state and a second state;

in the first state, the exhaust side is communicated with the external parts through the bypass valve, and in a second state, the exhaust side is communicated with the suction side through the bypass valve; and the compressor is configured, such that the bypass valve is switched from the first state to the second state when the motor portion is stopped from an operating state and such that the bypass valve is switched from the second state to the first state when the motor portion is started from a stopped state.

6. The compressor according to claim 1, wherein:

the compressor is configured, such that the bypass valve is switched from the first state to the second state when the motor portion is stopped from the operating state; and the compressor is configured, such that the bypass valve is switched from the second state to the third state when the motor portion is started from the stopped state, and after remaining in the third state for a preset time t, the bypass valve is switched to the first state when the motor portion is not stopped, and to the second state when the motor portion is stopped.

7. The compressor according to claim 1, further comprising: a reservoir having an outlet communicated with an air inlet of the compressing mechanism portion, and an air suction pipe provided at the reservoir;

wherein the suction side of the compressor comprises the reservoir and the air suction pipe; and wherein the sealing container defines a high-pressure containing cavity, an exhaust pipe is provided at the sealing container, and the exhaust side of the compressor comprises the high-pressure containing cavity and the exhaust pipe.

8. The compressor according to claim 1, wherein:

the sealing container defines a low-pressure first cavity and a high-pressure second cavity, and is provided with an air suction pipe in communication with the low-pressure first cavity and an exhaust pipe in communication with the high-pressure second cavity; and the suction side of the compressor comprises the low-pressure first cavity and the air suction pipe, and the exhaust side of the compressor comprises the high-pressure second cavity and the exhaust pipe.

9. A refrigeration device comprising:

a first heat exchanger, a throttle valve, a second heat exchanger, and the compressor according to claim 1, wherein:

a first connector of the first heat exchanger is connected to the bypass valve, the throttle valve is connected between a second connector of the first heat exchanger and a first connector of the second heat exchanger, and a second connector of the second heat exchanger is connected to an air suction port of the compressor.

10. A refrigeration device comprising:

a reversing device, a first heat exchanger, a throttle valve, a second heat exchanger, and the compressor according to claim 1, wherein:

the reversing device comprises a first opening, a second opening, a third opening and a fourth opening; and the first opening is connected to the bypass valve, the second opening is connected to a first connector of the first heat exchanger, the throttle valve is connected between a second connector of the first heat exchanger and a first connector of the second heat exchanger, a second connector of the second heat exchanger is connected to the fourth opening, and the third opening is connected to an air suction port of the compressor.

11. The compressor according to claim 4, wherein:

the at least one flow passage of the valve core comprises a first flow passage, a second flow passage and a third flow passage; and the first port and the second port are configured to communicate with each other through the first flow passage and the third port and the fourth port are configured to communicate with each other through the second flow passage, or the first port and third port are configured to communicate with each other through the third flow passage.

12. The compressor according to claim 11, wherein:

at least part of the valve core is movably provided in the valve body in an axial direction of the valve body;

the first port and the third port are provided at a first side surface of the valve body and spaced apart in the axial direction;

the second port and the fourth port are provided at a second side surface of the valve body and spaced apart in the axial direction;

two open ends of the first flow passage and two open ends of the second flow passage face the first side surface and the second side surface of the valve body respectively; and two open ends of the third flow passage face the first side surface of the valve body.

13. The compressor according to claim 12, wherein the first flow passage and the second flow passage are spaced apart in the axial direction of the valve core, and a width of the second flow passage in the axial direction of the valve core is greater than a width of the first flow passage in the axial direction of the valve core.

14. The compressor according to claim 6, wherein the preset time t is greater than or equal to 1 second and less than or equal to 10 seconds.

* * * * *